United States Patent [19]

Coker et al.

[11] 4,428,098

[45] Jan. 31, 1984

[54] BAG CLAMP

[76] Inventors: Terry Coker, 11737 Washington, Apt. 1403, Northglenn, Colo. 80234; Stanley W. Coker, 8954 Lander St., Westminster, Colo. 80030

[21] Appl. No.: 283,897

[22] Filed: Jul. 16, 1981

[51] Int. Cl.[3] ..... B65D 77/10; A44B 21/00

[52] U.S. Cl. ..... 24/30.5 R; 24/327; 24/487; 383/68; 383/69

[58] Field of Search ..... 24/30.5 R, 24, 42, 67.7, 24/327, 336, 346, 248 B, 248 R, 255 SL; 150/4–6, 16; 229/62, 65; 292/266, 269, 271–272, 277; 128/346

[56] References Cited

U.S. PATENT DOCUMENTS

| | | | |
|---|---|---|---|
| 190,787 | 7/1961 | Schacider | 24/248 R |
| 1,459,735 | 6/1923 | Kraft | 24/30.5 R |
| 1,840,217 | 1/1932 | Van Wie | 24/327 |
| 2,498,372 | 2/1950 | Kortlucke et al. | 24/327 |
| 3,259,302 | 7/1966 | Rocchisani | 24/30.5 R |
| 3,315,324 | 7/1965 | Ward | 24/30.5 R |
| 3,315,679 | 5/1967 | Sarracino | 128/10 |
| 3,551,965 | 1/1971 | Gordon | 24/248 |
| 3,566,873 | 3/1971 | Medges | 128/346 |
| 3,571,861 | 3/1971 | Olson | 24/30.5 |
| 3,629,905 | 12/1971 | Cote | 24/30.5 R |
| 3,823,533 | 7/1974 | Takabayashi | 24/255 SL |
| 3,874,042 | 4/1975 | Eddleman et al. | 24/255 SL |
| 3,978,555 | 7/1976 | Weisenthal | 24/255 SL |

FOREIGN PATENT DOCUMENTS

| | | | |
|---|---|---|---|
| 49475 | of 1889 | Fed. Rep. of Germany | 24/30.5 |

*Primary Examiner*—Gene Mancene
*Assistant Examiner*—John G. Weiss
*Attorney, Agent, or Firm*—Young & Martin

[57] ABSTRACT

A closure device adapted for clamping a flexible bag has a pair of hinged jaws including slideably mounted extension pieces adjustably retained in pre-selected positions of extension. The jaws are movable between a closed position to grip a bag and an open position to release the bag. A clasp mechanism releasably retains the jaws in the closed position. Mating sets of longitudinal teeth may be provided to grip the bag more positively.

12 Claims, 9 Drawing Figures

BAG CLAMP

BACKGROUND OF THE INVENTION

The present invention relates to apparatus for resealing a plexible bag such as a bag made out of paper or plastic commonly used in the food industry. The present invention is particularly useful with potato chip bags and the like which typically have a large mouth formed entirely along one edge. When such a bag is opened by the consumer, it is difficult to reseal the bag to protect unused contents. Thus, unless such person consumes the entire contents of the bag, it is difficult to reseal. Accordingly, the contents often become stale which forces the consumer to dispose of the uneaten portion of the food. This, of course, is wasteful and costly, but is understandable since the flavor and texture of the food is destroyed in a very short time after opening the bag.

This problem has been recognized in the past and several different bag clamps or other closure devices have been proposed to remedy the problem of unwanted spoilage of food once a flexible food container has been opened by the consumer. For example, U.S. Pat. No. 3,315,324, issued Apr. 25, 1967 to Ward discloses a bag closing device in the form of a clip having a pair of arms hinged together with the arms pivotal between an open and closed position. The clamp may thus be closed around the mouth of a bag and the arms secured together by means of a fastening clip. U.S. Pat. No. 3,571,861, issued Mar. 23, 1981 to Olson and U.S. Pat. No. 1,459,735, issued June 26, 1923 to Kraft also disclose similar bag clamps wherein a pair of arms are pivotally attached at one end so that the arms may be placed around the mouth of a bag once it has been opened. The free ends of the arms in each of these clamps are then securable to one another to clamp the mouth of the bag between the arms to substantially seal it against reopening. U.S. Pat. No. 3,629,905, issued Dec. 20, 1971 to Cote also shows a bag clamp with this clamp having a pair of hinged magnetic arms adapted to receive the mouth of a flexible bag with the arms being biased into a closed position so as to seal a bag placed therebetween.

While the prior art devices have accomplished their general objective, these devices have lacked any adjustment feature to accomodate bags of differing sizes. Indeed, several of these devices require that the mouth of the bag be bunched together in order to fit between the pivotal arms which, while appropriate for such items as bread wrappers and the like, is not suitable for other flexible bags such as used in the snack food industry. Further, the above-described bag clamps known in the prior art do not positively grip the bag in a direction parallel to the open mouth.

SUMMARY OF THE PRESENT INVENTION

It is an object of the present invention to provide a novel closure device for a flexible bag which can accommodate bags of varying sizes.

Another object of the present invention is to provide a bag closing device which has pivotal closing members that are adjustable in length yet which will positively grip and seal the open mouth of a flexible bag.

Yet another object of the present invention is to provide a novel bag clamp which positively grips the open mouth of a flexible bag in a direction generally parallel to its mouth.

Still a further object of the present invention is to provide a bag clamp wherein clamping members are adjustable in length and pivotal with respect to one another between an open position and a clamped position and which may be positively yet releasably retained in the clamped position.

The above objects are accomplished by the present invention which, in the preferred embodiment, provides a pair of clamp arms which are hinged together on one end and which each telescopically receive an extension member. The extension members are provided with a mating clasp assembly on their exterior ends. Preferably, the clamp arms are rectangular in cross section, having a generally hollow interior for receiving a solid rectangularly shaped extension piece.

The interior portion of each extension piece is truncated and has a pair of laterally-projecting wings, each terminating in a knuckle so that, when the extension piece is inserted in the clamp arm, these knuckles are resiliently biased against the interior sidewalls of the channel. A plurality of facing pairs of grooves are formed in the interior sidewalls of each clamp arm, so that, as the extension piece is moved therealong, the outwardly biased knuckles will engage each pair of grooves consecutively to releasably retain the extension piece in the selected position as defined by the grooves. Thus, the extension pieces are movable telescopically within the clamp arms so that they are retained in a plurality of pre-selected orientations.

As noted, the clamp arms are pivotal with respect to one another, so that an associated extension piece will also pivot. Accordingly, each clamp arm and its associated extension piece defines a jaw member with the two jaw members being hinged together for movement between an open and closed position. The jaw members are releasably retained in the closed position by means of a clasp assembly which includes a male member mounted on the exterior end of one of the extension pieces and a female member mounted on the exterior end of the other extension member. The male member is a resilient post having an enlarged head. The female member includes a first opening adapted to receive the male member and a second opening intersecting the first opening to define a transverse bar. The bar has a slanted face oriented at an angle with respect to the direction of movement of the male member into the first opening. The enlarged head attacks this slanted face to bend its resilient post and engages the bar upon full insertion into the first opening. A nub is hinged to the female member and is pivotable through the second opening to attack the male member to forcibly disengage its enlarged head from the transverse bar.

In the preferred form of the present invention, each clamp arm has a longitudinal slot in a sidewall to define a pair of inwardly projecting lips on either side of the slot. Each extension piece has a raised portion adapted to slide between the lips on an associated clamp arm in closefitting engagement. The raised portion has a planar upper surface and a height corresponding to the thickness of the lips so that the planar surface is generally coplanar with the exterior surface of each lip. This construction, then, allows the entension piece to be positively guided as it is moved within its respective clamp arm. In an alternate embodiment the raised portions may be provided with longitudinally oriented gripping teeth to more positively grip a bag placed between the jaw members.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

The present invention relates to an apparatus for releasably closing a flexible bag once it has been opened in order to prevent spillage or spoilage of the contents thereof. Preferably, the invention comprises a pair of jaw members which are hinged together and which are movable between a closed position where they are in closely spaced apart relation operative to clamp a bag and an open position operative to release the bag.

Figure 1:
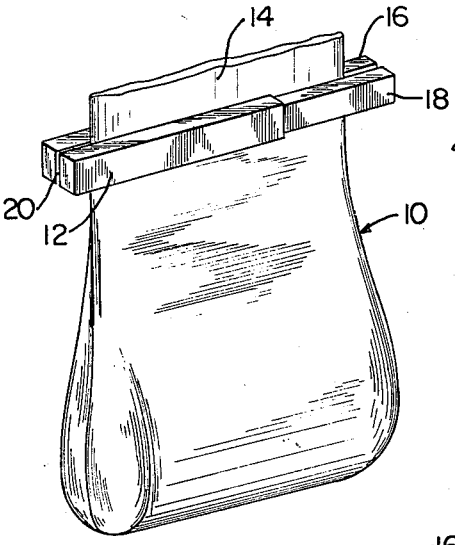
FIG. 1 shows a perspective view of a bag clamp according to the preferred embodiment of the present invention engaging the mouth of a flexible bag.

Thus, as is shown in FIG. 1, a bag 10 is securely fastened by bag clamp 12 when bag clamp 12 is in its closed position. Particularly, bag 10 has a mouth portion 14 which is clamped between a pair of clamp or jaw elements 16 and 18 which are hinged together at one end by means of a flexible hinge 20. The free ends of jaw elements 16 and 18 opposite hinge 20 are releasably secured together by means of a clasp mechanism. This clasp mechanism, described below, allows a user to open and close bag clamp 12 about the mouth portion 14 of bag 10 and to releasably secure bag clamp 12 in its closed position.

Figure 2:
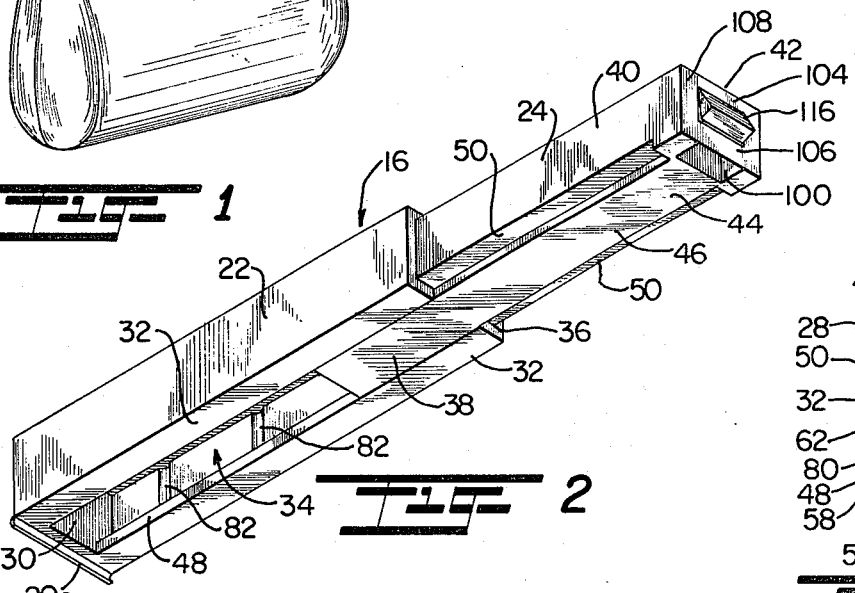
FIG. 2 is a perspective view of one jaw member according to the preferred embodiment of the present invention.
Figure 5:
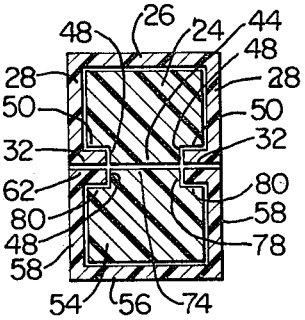
FIG. 5 is a transverse cross-sectional view of a bag clamp according to the preferred embodiment of the present invention shown in a closed position.

Jaw element 16, shown in greater detail in FIGS. 2 and 5, includes a clamp arm 22 and an extension element 24 which are preferably formed of a molded plastic material which exhibits some resilient characteristics. Clamp arm 22 is generally rectangular in cross-section having a hollow interior surrounded by a bottom wall 26, a pair of sidewalls 28 and a closed endwall 30 adjacent hinge 20. A pair of lips 32 extend at right angles inwardly from sidewalls 22 to define a longitudinal slot 34 extending from endwall 30 to open end 36 opposite endwall 30.

Extension member 24 is telescopically received into the hollow interior of clamp arm 22 so that it has an interior portion 38 and an exterior portion 40 which projects axially outwardly from clamp arm 22. Exterior portion 40 terminates in a female clasp member 42 described in greater detail below. Extension element 24 is generally rectangular in cross-section but has a longitudinal ridge 44 on the side thereof opposite bottom wall 26 of clamp arm 22 with ridge 44 defining a pair of longitudinal shoulders 50 on either side thereof. Ridge 44 has a width slightly smaller than the width of slot 34 so that ridge 44 is inserted into slot 34 in close-fitting engagement. Shoulders 50 thus receive lips 32 with ridge 44 positioned between interior edges 48 of lips 32 so that extension element 24 is positively guided by lips 32 as it telescopically moves in an axial direction within clamp arm 22. Ridge 44 has a flat upper surface 46 and a thickness equalling the thickness of lips 32. Thus, the exterior surfaces of lips 32 and surface 46 of ridge 44 lie substantially in the same plane to form a continuous surface.

Figure 3:
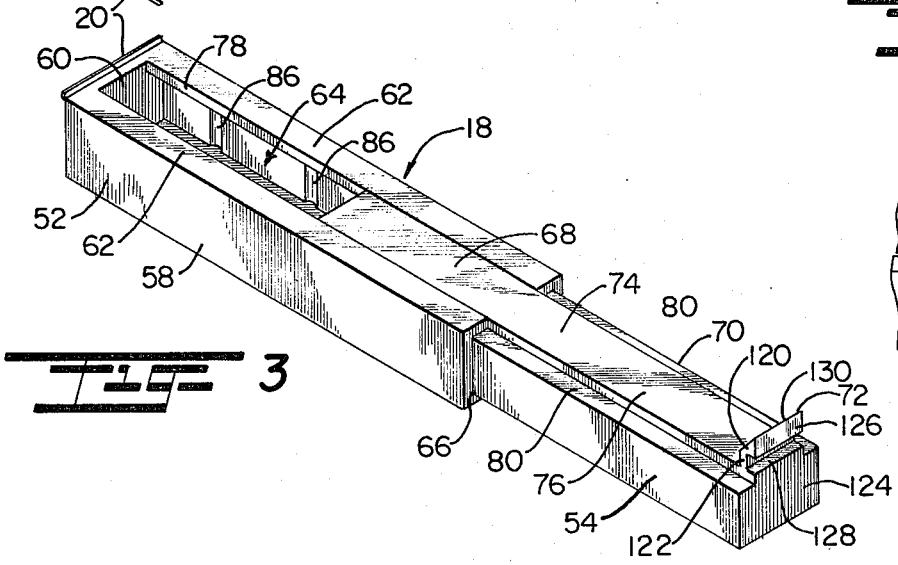
FIG. 3 is a perspective view of the other jaw member according to the preferred embodiment of the present invention.

The construction of jaw element 18, shown in FIGS. 3 and 5, is substantially similar to that of jaw element 16 with jaw element 18 being comprised of a clamp arm 52 and an extension element 54 which is telescopically received by clamp arm 52. Clamp arm 52 has a generally hollow interior surrounded by a bottom wall 56, a pair of sidewalls 58 and a closed endwall 60. Clamp arm 52 is preferably rectangular in cross-section and includes a pair of inwardly projecting lips 62 formed along sidewalls 58 at right angles thereto. Lips 62 define an elongated slot 64 which is oriented in an axial direction with respect to clamp arm 52. Extension element 54 is then received through an open end 66 opposite endwall 60 of clamp arm 52 so that it has an interior portion 68 and an exterior portion 70. A male clasp member 72 is mounted on the end of exterior portion 70 and is adapted to mate with female clasp member 42 as described in greater detail below.

Extension element 54 has an elongated ridge 74 formed on a surface opposite bottom wall 56 with ridge 74 having a flat upper surface 76. Ridge 74 defines a pair of longitudinal shoulders 80 and has a width slightly smaller than the width of slot 64 so that ridge 74 will fit into slot 64 in close engagement. Shoulders 80 thus receive lips 62 with ridge 74 positioned between interior edges 78 of lips 62. Ridge 74 has a thickness equalling the thickness of lips 62 so that the exterior surface of lips 62 and surface 76 form a flat, generally planar surface when extension element 54 is inserted into clamp arm 52.

From the above, it should be appreciated that clamp arms 22 and 52 are identical in construction and are attached to each other by means of a flexible hinge 20 which is connected to endwalls 30 and 60. While clamp arms 22 and 52 may be made of any suitable materials, in the preferred embodiment of the present invention they are molded out of a plastic material. Accordingly, hinge 20 may be formed unitarily with clamp arms 22 and 52 as an area of reduced thickness in a common molding process. Likewise, it is preferable that extension elements 24 and 54 be formed of a plastic material, although they may be formed out of other suitable materials known in the art.

Figure 4:
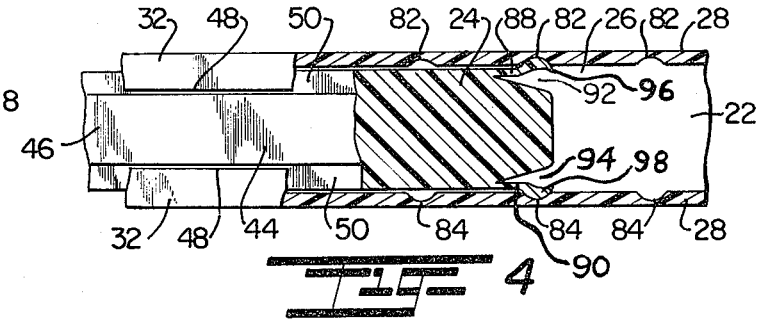
FIG. 4 is a view in partial cross-section of a jaw member according to the preferred embodiment of the present invention.

As noted above, both extension element 24 and extension element 54 are telescopically received respectively by clamp arms 22 and 52 so that they may be axially positioned at a desired location therein. With reference to FIGS. 2, 3 and 4, it may now be appreciated that extension elements 24 and 54 may be selectively positioned at various locations in their respective clamp arms 22 and 52 and be positively yet releasably secured in one of these pre-selected locations. To accomplish this, means is provided to retain each of extension elements of 24 and 54 in such a pre-selected location. FIG. 4 shows the preferred structure accomplishing this selective positioning as provided with respect to jaw element 16 comprised of clamp arm 22 and extension element 24. It should be understood that corresponding structure is provided for jaw element 18 comprised of clamp arm 52 and extension element 54. With reference, then, to FIGS. 2 and 4, it should be appreciated that several pairs of grooves 82 and 84 are formed in sidewalls 28 with each groove 82 facing a respective groove 84 in the opposite sidewall. Grooves 82 and 84 are formed in sidewalls 28 in a direction perpendicular to the axis of clamp arm 22 with each pair of grooves 82, 84 being spaced apart from adjacent pairs of grooves at pre-selected distances.

The interior portion 38 of extension element 24 terminates in a truncated nose having a pair of convergent sidewalls flanked by a pair of wings 88 and 90 formed by V-shaped cutout portions 92 and 94 respectively. Wings 88 and 90 are outwardly divergent from the longitudinal axis of extension element 24 and are biased against a respective wall 28 due to the resiliency of the plastic material. Wing 88 terminates in a semi-circular rounded portion or knuckle 96 which is sized to engage grooves 82. Similarly, wing 90 terminates in a semi-circular rounded portion or knuckle 98 sized to engage grooves 84. Accordingly, rounded knuckles 96 and 98 are oriented in a direction normal to the axis of extension element 24 and parallel to sidewalls 28 and are generally in the form of half cylinders. Thus, as extension element 24 is moved axially within clamp arm 22, knuckles 96 and 98 will engage respective pairs of grooves 82 and 84 as they become registered with the grooves. This structure, then, will releasably secure extension element 24 in one of several pre-selected positions in clamp arm 22. Likewise, due to its similar structure, extension element 74 is releasably securable in several pre-selected locations with respect to clamp arm 52 which has facing pairs of grooves, such as groove 86 shown in FIG. 3.

Jaw elements 16 and 18 are pivotal between a closed position gripping a mouth portion of a bag as shown in FIG. 1 and an open position adapted to receive the mouth portion of a bag, but it is desirable to retain jaw elements 16 and 18 in a closed position once a bag has been inserted therebetween. To this end, a clasp assembly is provided on the exterior ends of extension members 24 and 54 with the clasp assembly comprising a female clasp member 42 and a male clasp member 72 noted above.

Figure 6:
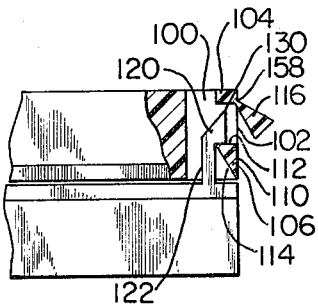
FIG. 6 is a side view in elevation and in partial cross-section showing the clasp assembly according to the preferred embodiment of the present invention.

With greater particularity, as is shown in FIGS. 2 and 6, female clasp member 42 is defined by a rectangular opening 100 which extends transversely through extension element 24 in a direction perpendicular to face 46. A second rectangular opening 102 is located perpendicularly to opening 100 so that it is parallel to the axis of extension element 24 as is shown in FIG. 6. Openings 100 and 102 intersect one another and thus define two parallel bars 104 and 106 which extend transversely across the end face 108 of exterior portion 40. Bar 104 is generally rectangular in cross-section, and bar 106 is generally triangular in cross-section. Bar 106 has a surface 110 which is coplanar with exterior face 108 of extension element 24 and a surface 112 formed at right angles to surface 110 and parallel to surface 46 of extension element 24. The third surface 114 of bar 106 extends between faces 110 and 112 so that opening 100 has a mouth adjacent ridge 44 which is outwardly divergent. A nub 116 is connected to bar 104 by a hinge 158 so that it is pivotal through opening 102.

Male clasp member 72 is best shown in FIGS. 3 and 6 where it should be appreciated that exterior portion 70 of extension element 54 terminates in a flat surface 124 oriented in a plane perpendicular to the axis of extension element 54. Male clasp member 72 has a head 120 in the form of a triangular prism which is mounted on top of a resilient upstanding wall 122 extending upwardly from ridge 74 which is positioned in a plane perpendicular to the longitudinal axis of extension element 54 adjacent surface 124. Head 120 has a face 126 that is oriented in plane that is parallel to face to 124. Wall 122 is thinner at its base than head 120, and thus a rectangular channel 128 is defined between ridge 74 and head 120 with an upper edge 130 of head 120 being positioned directly above channel 128 and forwardly of wall 122. Accordingly, when male clasp member 72 is mated with female clasp member 42, as is shown in FIG. 6, channel 128 receives bar 106 so that face 112 of bar 106 engages and abuts head 120.

In operation, then, the mouth portion 14 of a bag 10 may be substantially sealed by bag clamp apparatus 12. First, the lengths of jaw elements 16 and 18 are adjusted to a desired size by moving extension members 24 and 54 within their respective clamp arms 22 and 52 so that mouth portion 14 will just fit within jaw elements 16 and 18 as is shown in FIG. 1. Mouth portion 14 is then positioned between jaw elements 16 and 18, and they are moved to the closed position as is shown in FIGS. 1, 5 and 6. Extension elements 24 and 54 are positioned so that jaw members 16 and 18 have a common length so that, upon moving the bag clamps 12 into the closed position, male clasp member 72 is inserted into opening 100 of female clasp member 42. Since wall 122 is formed of a resilient material, such as plastic, as head 120 enters opening 100, edge 130 of head 120 attacks face 114 of bar 106. This causes male clasp member 72 to be bent back towards hinge 20 until it is fully inserted into opening 100. At full insertion, due to the corresponding size of channel 128 and the distance between face 112 and the plane of upper surface 46, triangular head 120 will spring into opening 102 and become interlocked with bar 106 as is shown in FIG. 6. Accordingly, jaw elements 16 and 18 will be maintained in a closed position. When the user desires to release bag clamp 12 from bag 10, it is only necessary to depress nub 116 so that it passes into opening 102 and abuts triangular head 120. Upon depressing nub 116 farther, head 120 is moved away from bar 106 so that bar 106 and head 120 are unlocked to release jaw elements 16 and 18 from each other. The jaw elements may then be moved apart to release mouth portion 14 of bag 10 from bag clamp 12.

Figure 7:
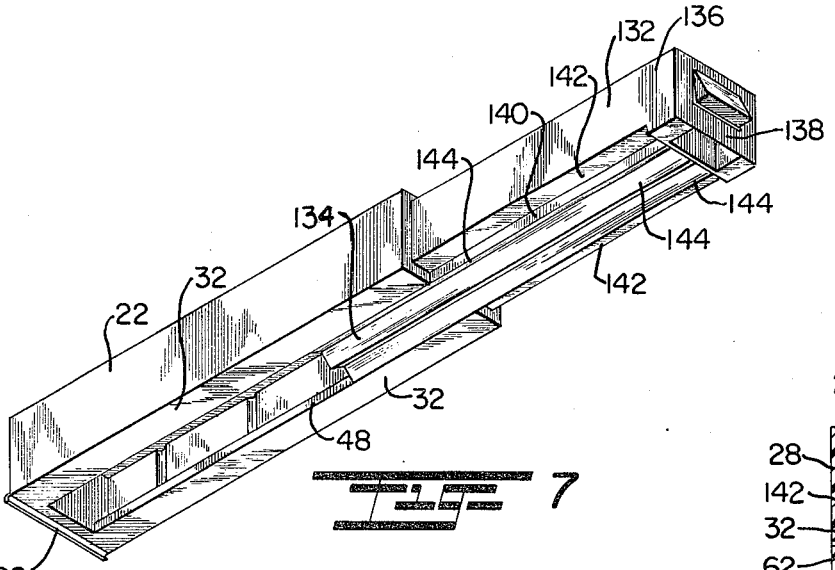
FIG. 7 is a perspective view of one jaw member according to an alternate embodiment of the present invention.
Figure 9:
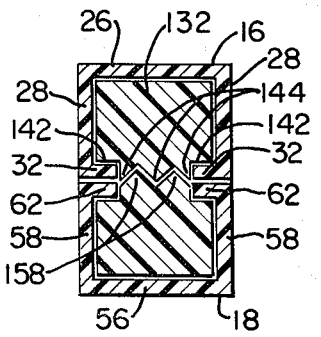
FIG. 9 is a transverse cross-sectional view of a bag clamp according to the alternate embodiment of the present invention shown in a closed position.
Figure 8:
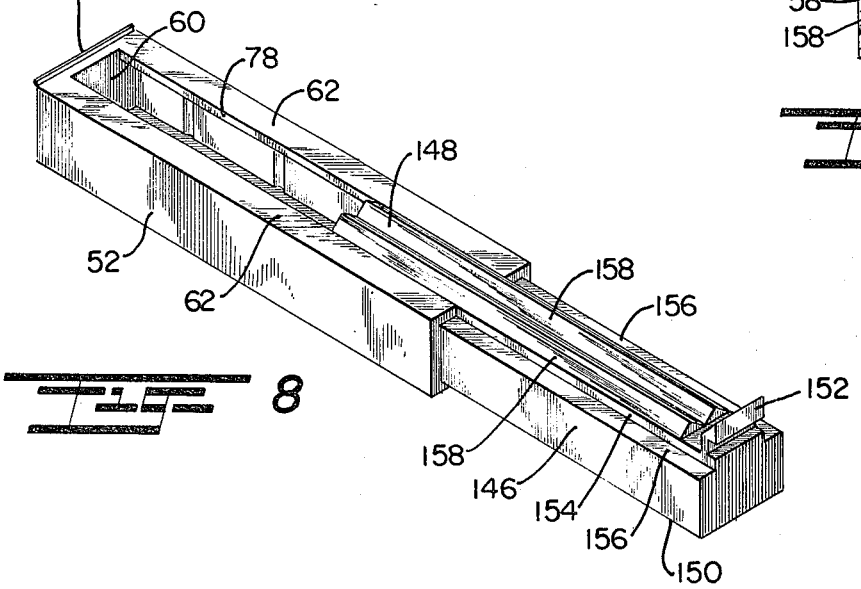
FIG. 8 is a perspective view of the other jaw member according to the alternate embodiment of the present invention.

FIGS. 7, 8 and 9 show an alternate embodiment of the present invention which departs from the structure described with respect to the preferred embodiment in that longitudinal rib or gripping teeth are provided on respective extension elements. Specifically, as is shown in FIG. 7, extension element 132 is inserted into clamp arm 22 in a manner similar to that described with respect to the preferred embodiment so that an extension element 132 has an interior portion 134 and an exterior portion 136 which extends axially outwardly from clamp arm 22. Female clasp member 138 is mounted on the outward end of exterior portion 136 and is formed identically to female clasp member 42, above. Extension element 132 has a longitudinal ridge 140 which is positioned between a pair of shoulders 142, and this ridge is received between edges 48 of lips 32 on clamp arm 22 when extension element 132 is inserted therein. However instead of having a flat surface 46 as described with respect to the preferred embodiment, ridge 140 has an upper surface formed as a plurality of longitudinal teeth 144 which extend from female clasp member 138 completely along its surface to inner end of interior portion 134. As is shown in FIG. 9, three such teeth 144 are formed on extension element 132 with these teeth being generally triangular in cross section.

In this alternate embodiment of the present invention, a second extension element 146 is provided and is mounted in clamp arm 52 as described with respect to the preferred embodiment. Extension element 146 has an interior portion 148 and an exterior portion 150 with exterior portion 150 supporting a male clasp member 152 at its extreme outward end with male clasp member 152 being constructed identically to male clasp member 72 according to the preferred embodiment. A longitudinal ridge 154 extends on an upper surface of extension element 146 between a pair of shoulders 156 with the upper surface of ridge 154 being formed as a plurality of teeth 158 oriented in a longitudinal direction from male clasp member 152 entirely along extension element 146 to the inner end of interior portion 148. As is shown in FIG. 9, a pair of such teeth 158 are provided and are triangular in cross-section. Teeth 158 are positioned to mate with teeth 144 of extension element 132 when jaw elements 16 and 18 are closed together.

Accordingly, the operation of the alternate embodiment of the present invention is identical to that described with respect to the preferred embodiment. The only difference provided by the structure of the alternate embodiment is found in the use of mating teeth 144 and 158 on extension elements 132 and 146, respectively. Hence, the mouth of a bag is clamped between the jaw elements provided with these teeth, the longitudinal teeth 144, 158 mate with one another to grip more positively the bag thereby resisting accidental removal of the bag from the bag clamp.

While the present invention has been described with some degree of particularity, it should be appreciated that the present invention is defined by the following claims construed in light of the prior art so that modifications or changes may be made to the preferred embodiment of the present invention without departing from the inventive concepts contained herein.

We claim:

1. A closure device for bags and the like, comprising:

a first jaw element defined by a first outer telescoping member having an open interior and a first inner telescoping member axially movable therein;

a second jaw element defined by a second outer telescoping member having an open interior and a second inner telescoping member axially movable therein, said first and second jaw elements pivotally connected to one another and movable between an open position and a closed position abutting one another for clamping a bag therebetween;

means secured to said first and second jaw elements for releasably clasping said first and second jaw elements in the closed position;

means secured to each of said first and second jaw elements for releasably retaining each said inner telescoping member in one of a plurality of discrete axial positions with respect to its respective outer telescoping member.

2. A closure device according to claim 1 wherein each said first and second outer telescoping members are rectangular in cross section and are formeed by a flat bottom wall, a pair of side walls, an end wall and a lip projecting inwardly from an upper edge of each side wall in a plane parallel to the bottom wall to define a generally open interior, each said first and second inner telescoping member configured for close fitting telescopic insertion into the open interior of its respective outer telescoping member.

3. A closure device according to claim 2 wherein each said inner telescoping member includes a longitudinal raised portion on a face opposite a respective said bottom wall of its associated outer telescoping member to define a shoulder on both sides of said inner telescoping member for receiving a respective lip, said raised portion having a width corresponding to the distance between said lips and having a height corresponding to the thickness of said lips.

4. A closure device according to claim 3 including a first set of teeth longitudinally oriented on the raised portion of said first inner telescoping member, and a second set of teeth longitudinally oriented on said second inner telescoping member, said first and second sets of teeth adapted to close-fitting engagement with one another when said jaw elements are in the closed position.

5. A closure device according to claim 4 wherein said inner telescoping member are formed of a resilient material and said means for retaining includes a plurality of spaced-apart grooves in one of said side walls of each outer telescoping member in a direction perpendicular to said bottom wall, each said inner telescoping member including a wing member attached to interior end thereof biased in an outwardly divergent direction and terminating in a knuckle adapted for engagement with a selected groove.

6. A closure device according to claim 1 wherein said means for clasping includes a male element mounted on the exterior end of one of said inner telescoping members and a female element mounted on the exterior end of the other one of said inner telescoping members, said male member insertable into and releasably engaged by said female member.

7. A closure device for bags and the like, comprising:

a first jaw element defined by a first pair of inner and outer telescoping members;

a second jaw element defined by second pair of inner and outer telescoping members, said first and second jaw elements pivotally connected to one another and movable between a closed position abutting one another and an open position;

said outer ones of said first and second pairs of telescoping members in each jaw element each having a generally hollow interior and including a flat wall portion having a flat surface facing the other jaw element, said flat wall portion having a longitudinal slot extending therethrough, said inner ones of said first and second pairs of telescoping members including a longitudinal raised portion positionable in the slot in its respective outer telescoping member;

said inner ones of said telescoping members each having an interior portion extending into the hollow interior of a respective said outer one of said telescoping members, each said interior portion terminating in a truncated end having a pair of convergent walls and an outwardly divergent and resilient wing adjacent each convergent wall, each said wing having a free end terminating in a knuckle, each said knuckle being biased by its associated resilient wing against an interior sidewall of a respective outer telescoping member when said inner and outer telescoping members are positioned in a telescoped relation;

said first inner telescoping member having a longitudinal first rib facing said second jaw element when said jaw elements are in said closed position, said second telescoping member having at least two longitudinal second ribs facing said first jaw element when said jaw elements are in said closed position, said first and second ribs positively engaging one another and operative to convolute a bag placed therebetween when said jaw elements are in said closed position; and a male clasp member mounted on one of said jaw elements and a female clasp member mounted on the other of said jaw elements, said female clasp member adapted for releasably receiving said male clasp member in mated relation to maintain said jaw elements in said closed position.

8. A closure device according to claim 7 wherein said raised portion on each said inner telescoping member has a substantially planar surface oriented in a common plane with the flat surface of its respective outer telescoping member.

9. A closure device according to claim 7 wherein said first and second ribs are formed on the raised portion on a respective said inner telescoping member.

10. A closure device according to claim 9 wherein said first and second ribs are triangular in cross section.

11. A closure device according to claim 7 wherein the interior side wall of each outer telescoping member has a plurality of spaced-apart cavities adapted for releasably engaging said knuckles.

12. A closure device according to claim 7 wherein said female clasp member has a first opening adapted for receiving said male clasp member and a second opening intersecting said first opening to define a bar therebetween, said bar having a slanted face oriented at an angle to the direction of entry of said male clasp member into said female clasp member, said male clasp member including an enlarged head mounted to a resilient post, said head attacking said slanted face as the male clasp member is inserted into said first opening to flex said post and engaging said bar to maintain said female clasp member and said male clasp member in a mated relation, and including a hinged nub operative to pivot into said second opening to disengage said bar and said enlarged head.

* * * * *